United States Patent [19]

Curtis et al.

[11] 3,971,587

[45] July 27, 1976

[54] U-SHAPED FURNITURE FRAME

[75] Inventors: William R. Curtis, New Castle; David C. Trimble, Yorklyn, both of Del.

[73] Assignee: Hercules Incorporated, Wilmington, Del.

[22] Filed: Sept. 30, 1975

[21] Appl. No.: 618,199

[52] U.S. Cl. ..... 297/452; 297/445

[51] Int. Cl.[2] ..... A47C 7/02

[58] Field of Search ..... 297/416, 418, 421, 440, 297/443, 445, 452

[56] References Cited

UNITED STATES PATENTS

| | | | |
|---|---|---|---|
| 3,556,594 | 1/1971 | Anderson | 297/452 |
| 3,658,382 | 4/1972 | Anderson | 297/445 |
| 3,814,478 | 6/1974 | Clark | 297/445 |

*Primary Examiner*—James C. Mitchell

*Attorney, Agent, or Firm*—Stanley A. Becker

[57] ABSTRACT

A U-shaped molded plastic furniture frame for use in fabrication of a barrel shaped chair. Each end of the frame has a box portion formed therein for receiving a front support member of a desired length to provide a chair having a preselected width. The frame also has facilities integrally molded therein for receiving the arms, legs and backs of a chair. Additionally, other facilities may be provided for the easy attachment of springs, spring supports, or other support members to the frame.

7 Claims, 6 Drawing Figures

U-SHAPED FURNITURE FRAME

BACKGROUND OF THE INVENTION

This invention relates to a furniture frame and particularly to a U-shaped molded plastic frame having integrally molded therein facilities for receiving arms, legs and back members, front supports and springs or spring supports to form a barrel shaped chair.

Heretofore, conventional frames for barrel shaped chairs have been fabricated from plywood, which is steam bent or otherwise bent into shape by hydraulic presses or the like or is sawed in order to form the necessary rounded side and back configurations. Such frames have been expensive, as well as difficult to fabricate. Additionally, such frames have to be relatively heavy in order to provide desired strength characteristics. Additionally, the attachment of arms, legs and backs to such frames has involved time consuming labor.

The present invention is directed to a furniture frame that overcomes the foregoing problems.

SUMMARY OF THE INVENTION

This invention relates to a U-shaped molded plastic furniture frame having integrally molded therein facilities for receiving arms, legs and back members to form a barrel shaped chair. Each end of the U-shaped plastic member has a box portion formed therein for receiving a horizontal front support member which may be of varying lengths to provide a chair having various widths. Facilities are also provided for attaching springs or spring supports and other supporting members to the frame.

The subject frame permits easy assembly of arms, legs and back members to form a barrel shaped chair and still has flexibility to allow various design configurations such as, for example, rocking type chairs or swivel type chairs as well as four-legged chairs, and chairs with different shapes and different types of springing. A barrel shaped chair as used herein refers to an upholstered occasional chair having a curved back and curved sides.

Other advantages of the present invention will be apparent from the following detailed description of the invention when considered in conjunction with the following detailed drawings, which drawings form a part of the specification. It is to be noted that the drawings illustrate only typical embodiments of the invention and are therefore not to be considered limiting of its scope for the invention may admit to other equally effective embodiments.

BRIEF DISCUSSION OF THE DRAWINGS

DESCRIPTION OF THE INVENTION

Figure 1:
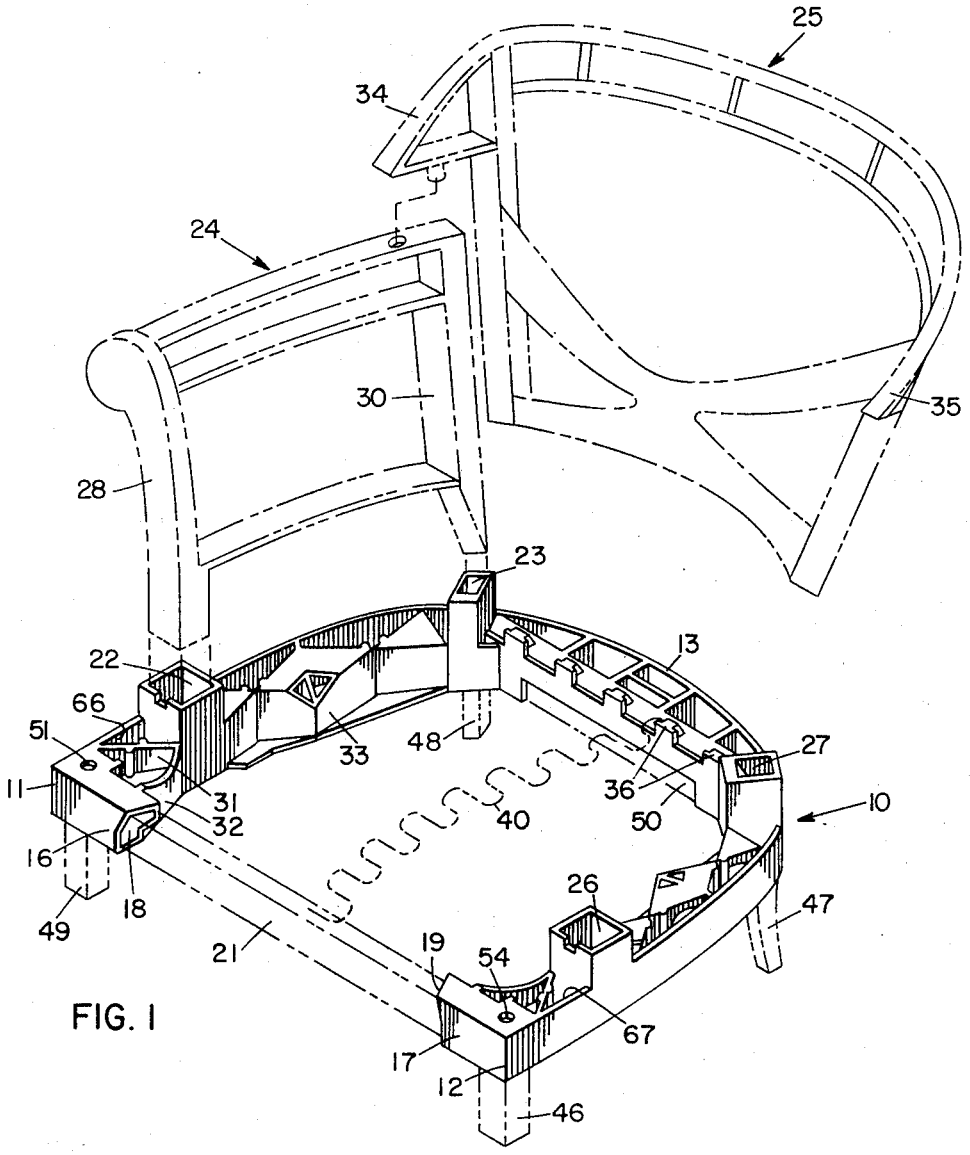
FIG. 1 is a perspective view illustrating the top side of the U-shaped furniture frame and showing in phantom certain of the other components of the chair which attach thereto.

Referring now to FIG. 1, there is shown a U-shaped frame which is designated as 10 having end portions 11 and 12 interconnected by an intermediate portion 13. The frame 10 is a unitary structure which is molded from any synthetic material having suitable strength and stapling characteristics. Preferably, the frame is molded of polypropylene structural foam. End portion 11 of the frame 10 has an inwardly projecting box portion 16 opposite to an inwardly projecting box portion 17 of end portion 12. Each box portion 16 and 17 has an opening 18 and 19 respectively for receiving a front support member 21, generally made of wood. The length of the front support member 21 may vary as desired to make chairs of various widths. Due to the shape of the frame, there is considerable flexure in the intermediate portion 13 to allow the ends of the box portions 16 and 17 to move both toward and away from each other a sufficient distance in order to install and accommodate front support members 21 of different lengths.

Frame 10 has box sections 22 and 23 molded on one side thereof for receiving vertical front and rear members 28 and 30 of an arm support 24. Similarly, box sections 26 and 27 are molded in the other side of the frame 10 to receive the vertical members of another arm support (not shown).

The arm supports also provide means by which a back member 25 is attached to the frame. While the back member may be attached in any suitable manner, as illustrated in FIG. 1, the back member usually has projecting sides 34 and 35 which rest on the top of the respective arm supports 24. Typically, the back member is attached in several places to both the horizontal and vertical members of the arm supports. The back member may be made of wood, but preferably is also molded of plastic.

A plurality of gussets are integrally molded into the frame to provide strength and structural integrity to the frame. Such gussets include gussets 31 and 32 between box member 22 and box portion 16, and a plurality of gussets generally designated as 33 intermediate box sections 22 and box section 23. Similarly, suitable gussets are provided on the other side of the frame. The gussets also provide a place to attach strings for hand tied springs or to attach drop-in spring assemblies.

Figure 3:
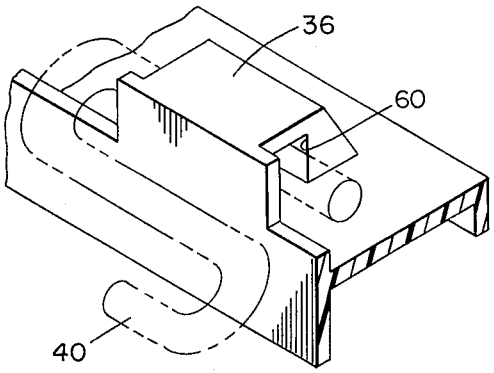
FIG. 3 is an enlarged perspective view of a portion of the frame of FIG. 1 illustrating the facilities for attaching sinusoidal springs to the frame.

Integrally molded in the intermediate section 13 of the frame 10 are a plurality of projections 36 for attaching the ends of sinusoidal springs 40. Sinusoidal springs 40 are installed in a bowed position, as shown in FIG. 1, extending across the opening or seat portion of the frame 10. Each projection 36 has a hole 60 therethrough for receiving an end of the spring 40, as shown in FIG. 3. The other ends of the springs 40 are attached to front support member 21. While sinusoidal springs are conveniently used, other springs, such as coil springs, could be utilized instead.

Figure 2:
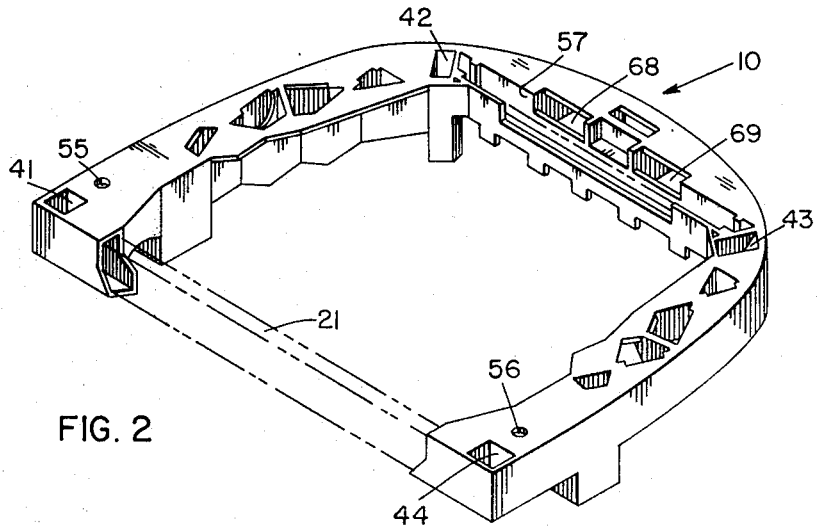
FIG. 2 is a perspective view of the bottom side of the frame shown in FIG. 1.

The legs of the chair can be stapled, bolted or otherwise fastened to the bottom of the frame. As shown in FIG. 2, the frame 10 has on its bottom side thereof four openings 41, 42, 43 and 44 for receiving legs 46, 47, 48 and 49 respectively, shown in phantom in FIG. 1. The front legs 46 and 49 may be stapled to the frame or bolted to the top of the frame by means of a threaded fastener (not shown) which extends through the holes 51 and 54. The rear legs 47 and 48 are inserted into openings 42 and 43 and are usually attached thereto by stapling. Of course, other suitable means of fastening these legs to the chair may be utilized, however, stapling is a most convenient, economical and expeditious means for assembling fixed legs to a chair. Additionally, knock down or screw-on legs can be used by installing commercial T-nuts, nuts having flanged shoulders formed integrally therewith, into openings 55 and 56 from the top side of frame 10 and subsequently screwing legs with threaded bolts attached thereto into the T-nuts from the underside of the frame.

For rear knock down or screw-on legs, a rear support member or board 50, shown in phantom in FIG. 1, can be inserted into opening 57 which extends across the back of the frame 10. Suitable holes and T-nuts can be provided in board 50 to receive the threaded bolts of the desired screw-on rear legs.

Figure 4:
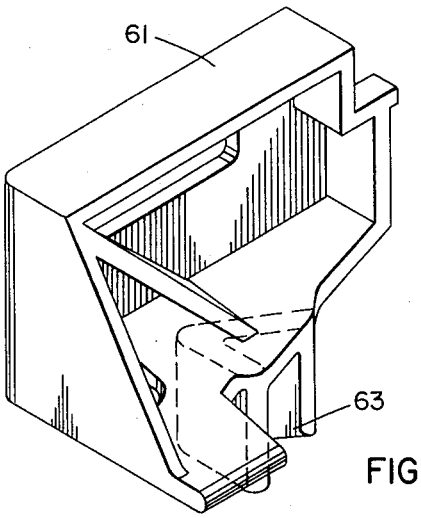
FIGS. 4 and 5 are perspective views of optional hard corner members which can be inserted into the frame.
Figure 5:
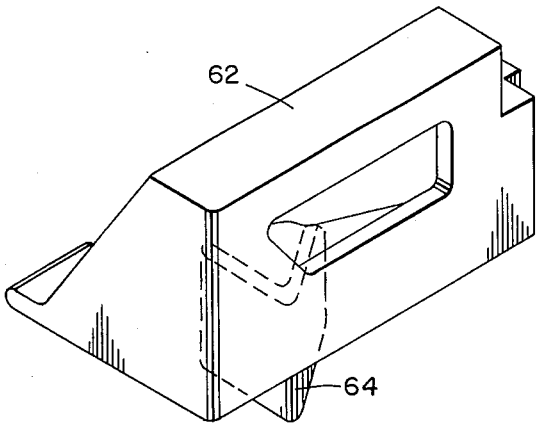
Figure 6:
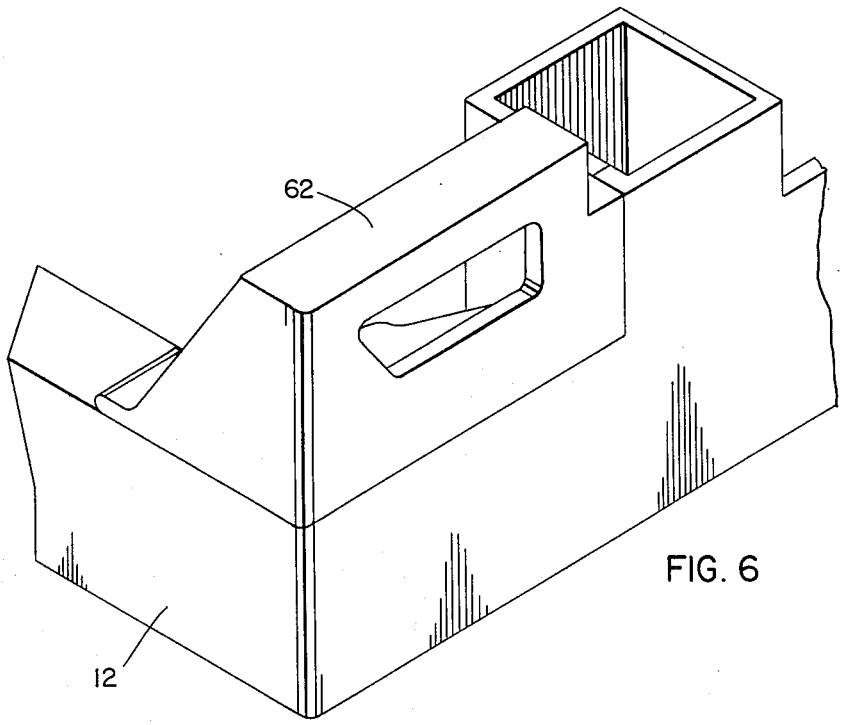
FIG. 6 is an enlarged perspective view of a portion of the frame shown in FIG. 1 illustrating the attachment of the hard corner member shown in FIG. 5.

The frame 10 as illustrated in FIG. 1 is used in a chair having what is known as a soft corner, namely a front corner with sufficient clearance to allow upholstery springing to be installed so that it forms a resilient corner. If a hard corner chair, namely one having rigid upholstered front corners, is desired, hard corners can either be integrally molded to frame 10, or can be separately molded and subsequently attached to the frame 10. Referring to FIGS. 4 and 5, there is shown a pair of separate hard corners 61 and 62. The hard corners have formed on their undersides projecting portions 63 and 64 which can be inserted into openings 66 and 67 respectively in the frame 10 shown in FIG. 1. FIG. 6 illustrates one corner of frame 10 with hard corner 62 inserted therein.

While reference has been made above to using fixed legs in a chair, a swivel mechanism or a rocker mechanism could easily be attached to boards or brackets fastened to the bottom of frame 10 to make a swivel or rocking type chair. Openings 68 and 69 (FIG. 2) receive ends of boards (not shown) which extend across the frame and have their other ends fixed to front support member 21. This provides a suitable support for attachment of the swivel or rocker base. Alternatively, boards could be attached to the sides of the frame and extend across the opening thereof parallel to front support member 21. The padding and upholstery can easily be affixed to any portion of the frame by stapling, or other suitable means of attachment.

What we claim and desire to protect by Letters Patent is:

1. A furniture frame for a barrel shaped chair comprising:

an integral U-shaped member made of plastic material, each end thereof having an inwardly projecting box portion for receiving a horizontal support member;

said ends being movable toward and away from each other due to the flexure of the U-shaped member to accommodate various lengths of support members to form a chair of varying widths;

said U-shaped member having means intermediate the ends thereof formed therein in the top thereof for receiving vertical arm supports; and said U-shaped member having means formed therein in the bottom thereof for receiving legs.

2. A furniture frame for a barrel shaped chair as set forth in claim 1 including means for securing the ends of bowed sinusoidal springs to said U-shaped member.

3. A furniture frame for a barrel shaped chair as set forth in claim 2 wherein said securing means comprises a plurality of projections integrally molded into said frame, each projection having an opening therethrough for receiving and end of a sinusoidal spring.

4. A furniture frame for a barrel shaped chair as set forth in claim 1 wherein the back portion of said U-shaped member has an opening in the underside thereof for receiving a rear support member.

5. A furniture frame for a barrel shaped chair as set forth in claim 1 wherein the back portion of said U-shaped member has a plurality of openings for receiving the ends of support members which extend parallel to the sides of said U-shaped member.

6. A furniture frame for a barrel shaped chair as set forth in claim 1 wherein the top has openings therein adjacent to each of the ends for receiving corner members to provide a built up hard corner.

7. A furniture frame for a barrel shaped chair as set forth in claim 1 including means for receiving threaded ends of screw-on type legs.

* * * * *